US005351475A

United States Patent [19]

Ansart et al.

[11] Patent Number: 5,351,475

[45] Date of Patent: Oct. 4, 1994

[54] AERODYNAMIC FUEL INJECTION SYSTEM FOR A GAS TURBINE COMBUSTION CHAMBER

[75] Inventors: Denis R. H. Ansart, Bois le Roi; Denis J. M. Sandelis, Nangis, both of France

[73] Assignee: Societe Nationale d'Etude et de Construction de Motors d'Aviation, Paris, France

[21] Appl. No.: 136,263

[22] Filed: Oct. 15, 1993

[30] Foreign Application Priority Data

Nov. 18, 1992 [FR] France ..... 92 13832

[51] Int. Cl.[5] ..... F02C 3/06

[52] U.S. Cl. ..... 60/39.36; 60/746

[58] Field of Search ..... 60/740, 748, 39.37, 60/737, 738, 746, 39.36

[56] References Cited

U.S. PATENT DOCUMENTS

| | | | |
|---|---|---|---|
| 3,521,824 | 7/1970 | Wilcox . | |
| 3,834,159 | 9/1974 | Vdoviak . | |
| 4,045,956 | 9/1977 | Markowski et al. . | |
| 4,162,611 | 7/1979 | Carmel et al. . | |
| 4,218,020 | 8/1980 | Reider | 60/748 |
| 4,696,157 | 9/1987 | Barbier et al. . | |
| 4,850,194 | 7/1989 | Füglistaller | 60/748 |

FOREIGN PATENT DOCUMENTS

| | | | |
|---|---|---|---|
| 3837635 | 5/1990 | Fed. Rep. of Germany | 60/737 |
| 2028488 | 3/1980 | United Kingdom . | |

OTHER PUBLICATIONS

"Calculus with Analytic Geometry" Second Edition, Robert Ellis and Denny Gulick, p. 566, ©1982.

*Primary Examiner*—Richard A. Bertsch
*Assistant Examiner*—William J. Wicker
*Attorney, Agent, or Firm*—Bacon & Thomas

[57] ABSTRACT

A fuel injection system is disclosed which incorporates a plurality of bowl or shroud members extending upstream of an end wall of the combustion chamber between the end wall and an air swirler in which the shroud member has an end joined with the end wall of the combustion chamber having a substantially elongated elliptical cross-sectional configuration. The end wall of the combustion chamber defines an elliptical shaped opening corresponding to the shape of the end of the shroud or bowl member to enable the fuel/air mixture to be atomized as it enters the combustion chamber. The bowl or shroud member may also define a plurality of openings to enable additional air to be mixed with atomized fuel cone.

5 Claims, 4 Drawing Sheets

FIG. 2
(PRIOR ART)
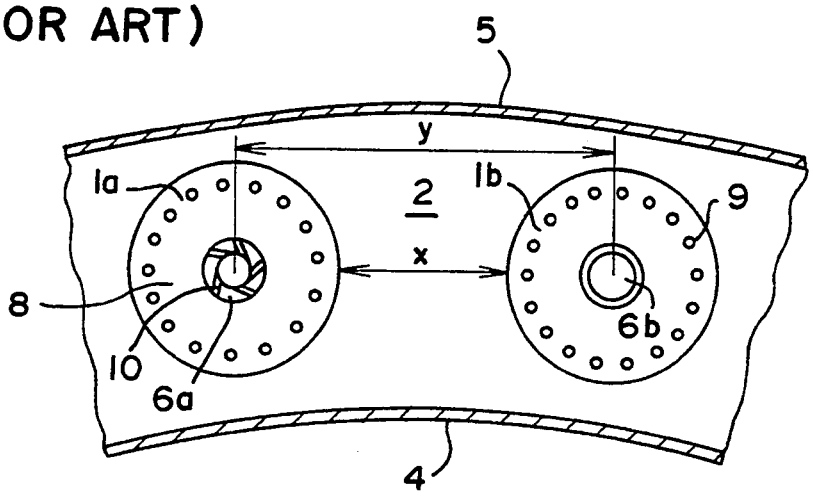
FIG. 3
(PRIOR ART)
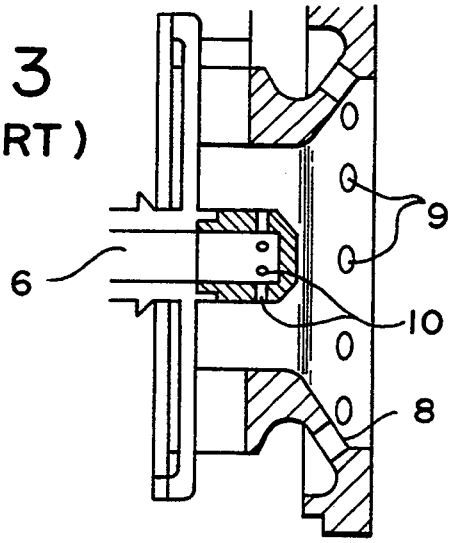
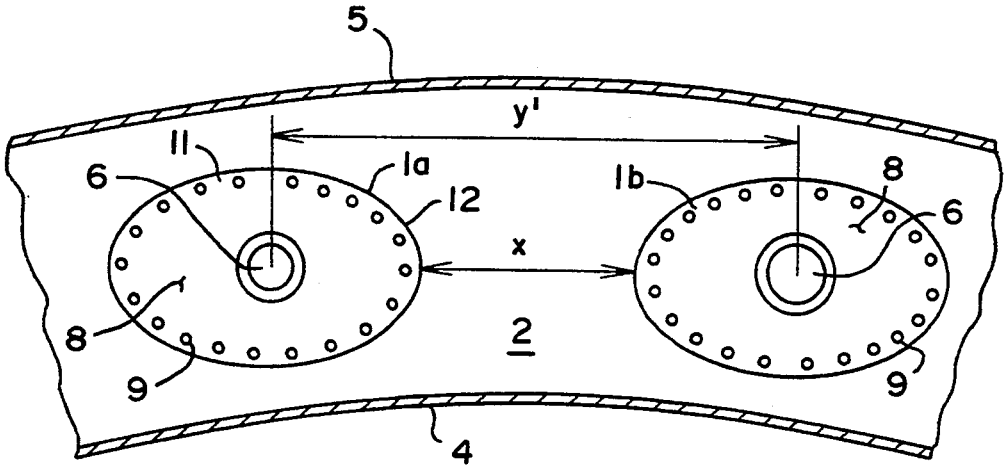
FIG. 5

AERODYNAMIC FUEL INJECTION SYSTEM FOR A GAS TURBINE COMBUSTION CHAMBER

BACKGROUND OF THE INVENTION

The present invention relates to an aerodynamic fuel injection system for an annular combustion chamber of a gas turbine engine, the system having at least one injection head with a plurality of air and fuel injectors circumferentially arrayed at the end of the combustion chamber.

U.S. Pat. Nos. 3,834,159 and 4,045,956, as well as U.K. Patent 2028488 disclose combustion chambers wherein the fuel injectors are circumferentially arrayed around the end of annular combustion chamber and are alternately spaced with air inlets. The alternating array of injectors and air intake apertures results in a circumferentially heterogeneous local richness of the fuel/air mixture in the primary zone of the combustion chamber.

U.S. Pat. No. 4,162,611 represents the state-of-the-art of such fuel injection systems and discloses an injection system wherein each of the fuel and air injection sets comprises a fuel injector, an air swirler located around the fuel injector to allow the fuel atomizing air to pass therethrough and a bowl-shaped unit which flares outwardly in a downstream direction from the swirler to the end of the combustion chamber and which defines a row of holes to allow air to mix with the atomized fuel cone. The bowls are arrayed circumferentially around the end of the combustion chamber and are spaced a set distance from each other. Since the bowls are circular in cross section, the number of injectors in the combustion chamber will be high.

SUMMARY OF THE INVENTION

A fuel injection system is disclosed which incorporates a plurality of bowl or shroud members extending upstream of an end wall of the combustion chamber between the end wall and an air swirler in which the member has an end joined with the end wall of the combustion chamber having a substantially elongated elliptical cross-sectional configuration. The end wall of the combustion chamber defines an elliptically shaped opening corresponding to the shape of the end of the shroud or bowl member to enable the fuel/air mixture to be atomized as it enters the combustion chamber.

The bowl or shroud member may also define a plurality of openings to enable additional air to be mixed with the atomized fuel cone.

The design of the shroud or bowl members enables the number of fuel injectors to be reduced without any degradation of the efficiency of operation of the combustion chamber.

The orientation of the shroud or bowl members are such that the largest lateral dimension of the substantially elongated elliptical cross-sectional end extends generally circumferentially about the end wall of the combustion chamber. The fuel injector nozzle defines a plurality of fuel injection holes which may be of different diameters such that the design achieves a flatter flame front.

The fuel injector and shroud member according to the present invention may be utilized in a gas turbine engine having a single injection head, or may also be utilized with gas turbine engines having multiple, radially spaced injection heads. When the design is incorporated into a combustion chamber having dual, radially spaced apart injection heads, the mean richness of the fuel/air mixture can be increased near the injectors.

BRIEF DESCRIPTION OF THE DRAWINGS

FIG. 2 is a partial, rear view of the injection head illustrated in FIG. 1.

FIG. 3 is a cross-sectional view of the fuel injector and shroud structure of the injection head illustrated in FIG. 1.

FIG. 5 is a partial, rear view of the injection head illustrated in FIG. 4.

DETAILED DESCRIPTION OF THE PREFERRED EMBODIMENT

Figure 1:
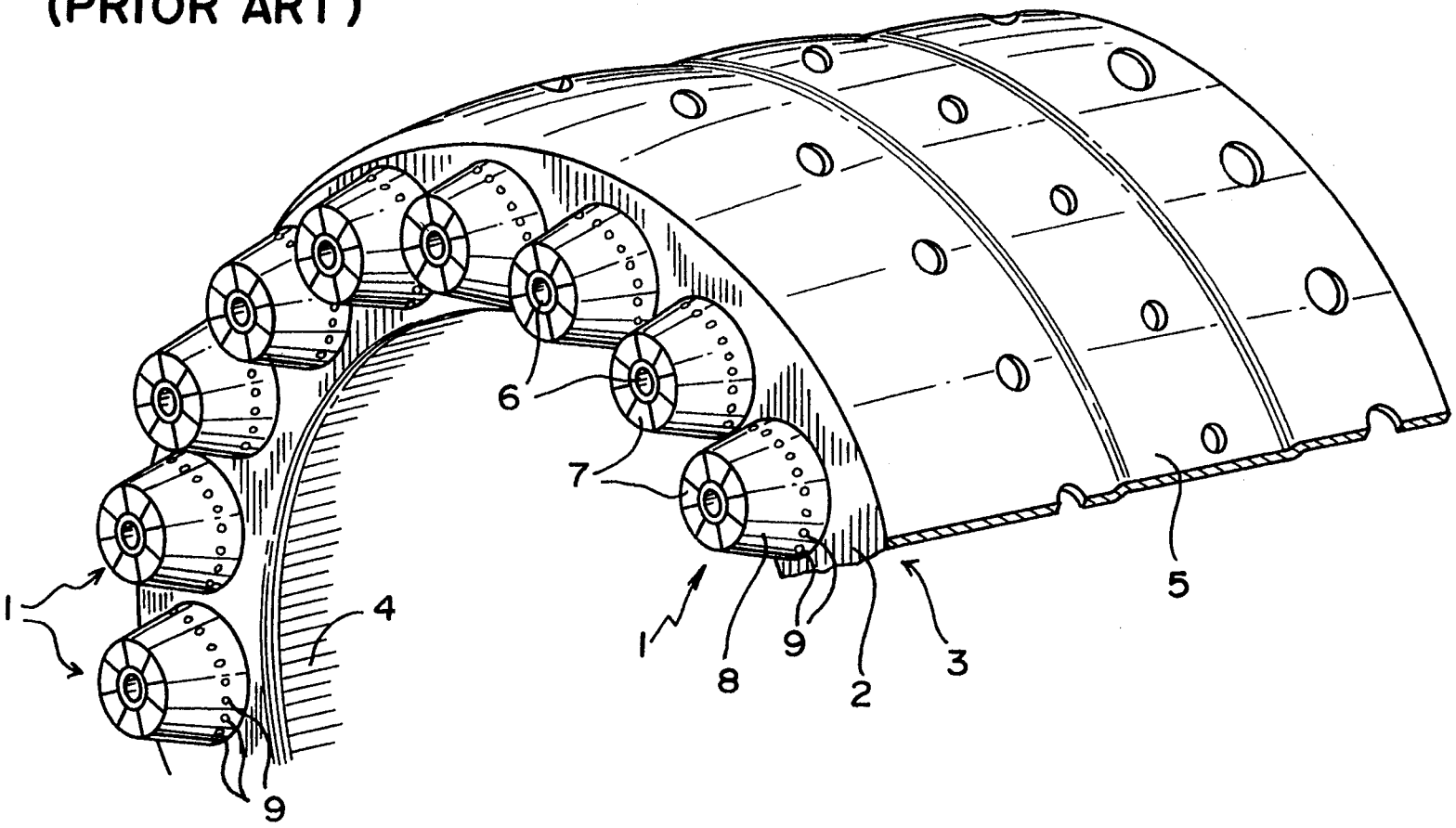
FIG. 1 (PRIOR ART)
FIG. 1 is a partial, perspective view of a combustion chamber having an injection head according to the prior art.

FIGS. 1 and 2 illustrate a known fuel injection head comprising a plurality of bowls 1 extending upstream from the end wall 2 of the annular combustion chamber 3. The annular combustion chamber 3 is bounded by an inner wall 4 and an outer wall 5 which are joined at the upstream ends by chamber end wall 2. The bowls 1 have a generally frusto-conical configuration with a circular cross-section. The bowls extend upstream from the chamber end wall 2 and are joined with a known air swirler 7 and enclose a fuel injector 6. The bowls 1 comprise a shroud member 8 which flares outwardly in a downstream direction from the air swirler 7 (in the direction of gas flow) and which define a row of holes 9 to allow air to pass therethrough into the atomized fuel cone within the bowl member. As best illustrated in FIGS. 2 and 3, the fuel is supplied through fuel injector 6 which defines a plurality of orifices 10 located within the shroud 8 such that fuel passing into the shroud 8 through the orifices 10 is atomized by the swirling air entering through air swirler 7.

Adjacent bowls 1*a* and 1*b* are spaced apart a distance X which results in a distance Y between adjacent fuel injectors 6*a* and 6*b*. In this particular instance, Y is equal to X plus the diameter of a bowl 1.

In the present invention, the bowls 1 comprise a shroud 8 having a downstream end 11 adjoining the chamber end wall 2 with a substantially elongated elliptical cross-section. The elliptical cross-section is oriented such that its smaller lateral dimension extends generally along a radius of the annular combustion chamber and the larger lateral dimension extends generally circumferentially about the combustion chamber 3. The chamber end wall 2 defines a plurality of substantially elongated elliptically-shaped orifices 12 having a shape similar to that of the end of the shroud 8 to enable the shroud to communicate with the combustion chamber. As in the previous embodiment, shroud 8 also defines a plurality of holes 9 to allow air to enter therethrough and be mixed with the atomized fuel cone. However, the holes 9 are no longer equidistantly spaced from the fuel injector 6 due to the elliptical shape of this portion of the shroud 8. Thus, the distance Y′ between two adjacent fuel injectors 6*a* and 6*b* is increased relative to the distance Y of the prior art devices, while at the same time maintaining the distance X between two adjacent bowls 1*a* and 1*b* of the prior art devices. Thus, the present design requires fewer fuel injectors to properly supply the combustion chamber 3.

The plurality of holes 9 may be equidistantly spaced from each other and all may have the same, or similar, diameter. However, it is within the scope of this invention to array the holes 9 at varying intervals from each other in order to distribute the incoming air as may be necessary in particular design parameters. The holes may be distributed over sectors wherein the sectors have holes of different diameters, as suggested in U.S. Pat. No. 4,696,157.

The fuel injector 6 utilized in the present invention defines a plurality of fuel injection holes 10 distributed about its periphery in order to inject fuel into the swirling air passing through air swirler 7. The injection holes 10 have different diameters in order to better homogenize the atomized fuel/air mixture fed into the combustion chamber 3. Preferably, the injection holes 10 are distributed in first sectors, which comprise the smaller diameter injection holes 10 and second sectors which comprise the larger diameter injection holes 10.

Figure 4:
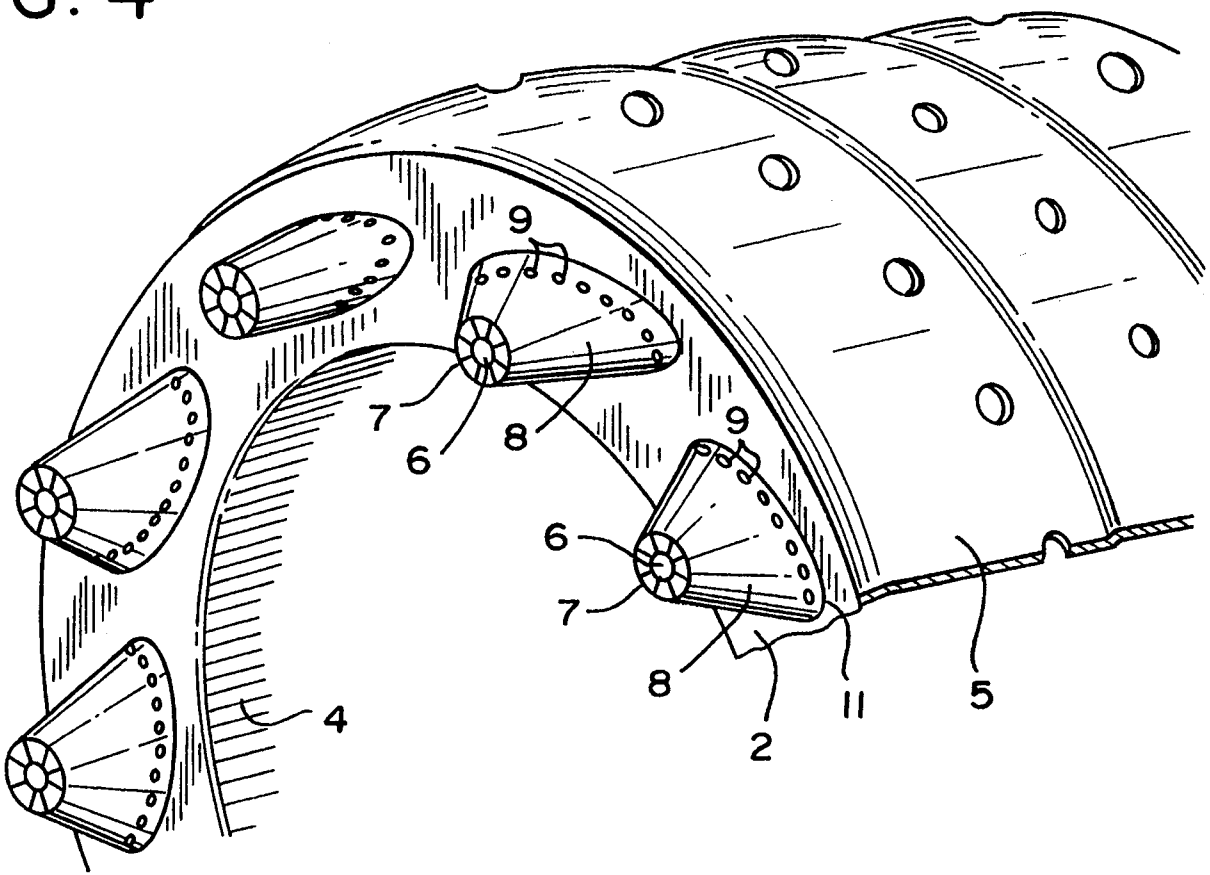
FIG. 4 is a partial, perspective view of a combustion chamber incorporating an injection head according to the present invention.
Figure 6:
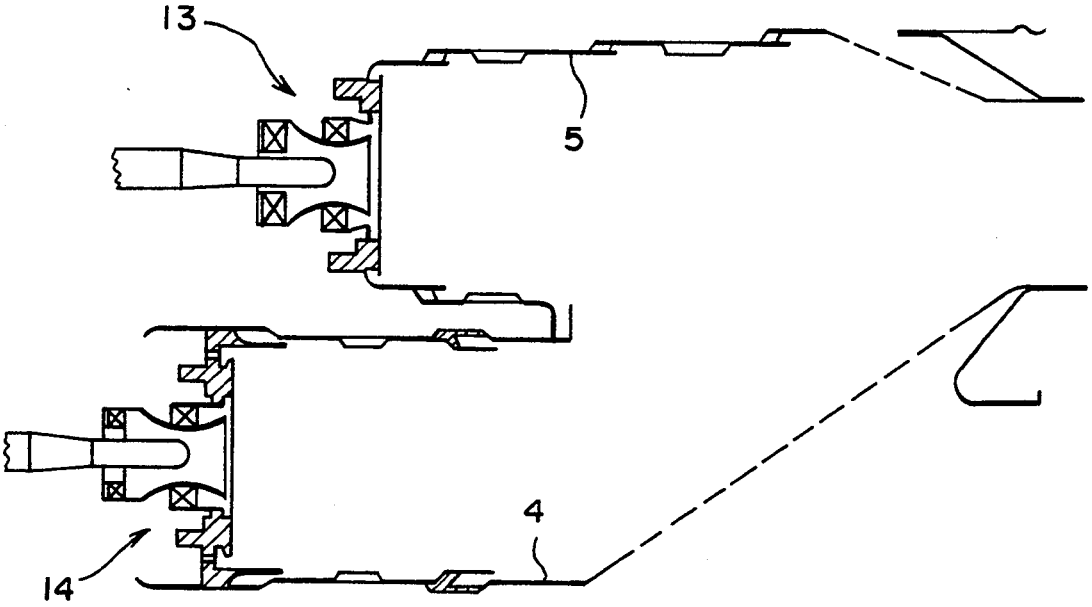
FIG. 6 is a partial, longitudinal, cross-sectional view of a combustion chamber having dual injection heads according to the present invention.
Figure 7:
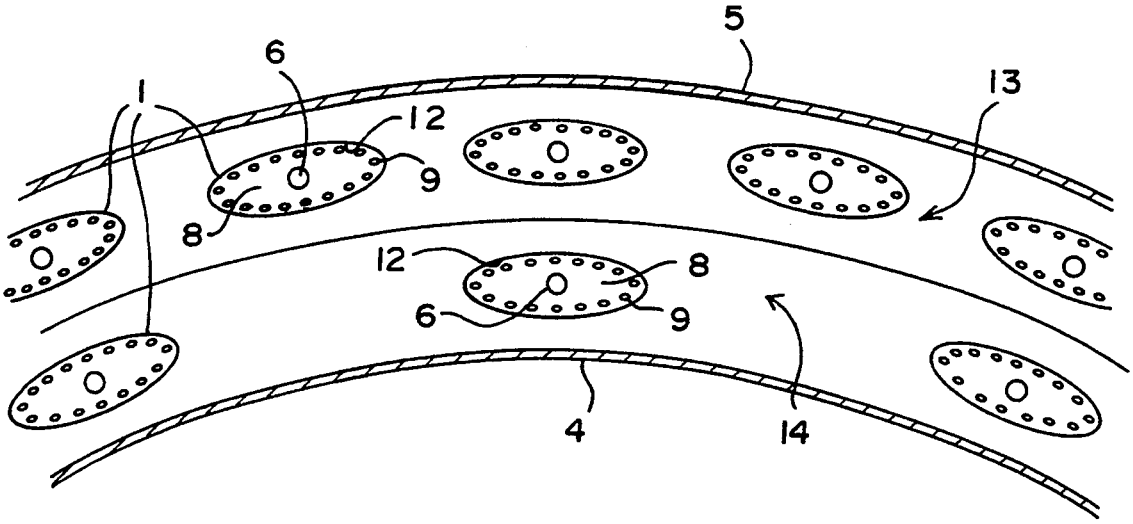
FIG. 7 is a partial, rear view of the dual injection head illustrated in FIG. 6.

FIGS. 4 and 5 illustrate the present invention utilized in a single injection head. As illustrated in FIGS. 6 and 7, the features of the present invention may also be incorporated into combustion chambers have dual injection heads 13 and 14. As is well known in the art, such dual injection heads typically comprise a high power or takeoff head 13 and a low-power head 14 which are generally annular in configuration and are radially spaced apart about the upstream end of the combustion chamber. The circumferential space between adjacent bowls 1 of the low-power head 14 is larger than that between adjacent bowls 1 of the high-power head 13. Thus, the total number of bowls 1 having elliptical shrouds 8 serving the combustion chamber 3 is less than the number of circular bowls required to serve the same dual injection head combustion chamber.

The foregoing description is provided for illustrative purposes only and should not be construed as in any way limiting this invention, the scope of which is defined solely by the appended claims.

We claim:

1. An injection system for an annular combustion chamber with an end wall comprising: at least one injection head with a plurality of air and fuel injection sets, each injection set comprising:

a) a fuel injector;

b) an air swirler extending around the fuel injector;

c) at least one substantially elongated elliptical opening defined by the end wall; and, d) a shroud member extending between the air swirler and the end wall, the shroud member having an end with a substantially elongated elliptical cross-section in alignment with the elliptical opening of the end wall.

2. The injection system of claim 1 wherein the largest lateral dimensions of the substantially elliptical opening and the substantially elongated elliptical end of the shroud member extend substantially elongated circumferentially around the annular combustion chamber.

3. The injection system of claim 1 wherein the fuel injector defines a plurality of fuel injection holes distributed about a periphery of the fuel injector.

4. The injection system of claim 1 further comprising a first injection head and a second injection head spaced radially inwardly of the first injection head.

5. The injection system of claim 4 wherein the spacing between adjacent injection sets in the first injector head is less than the spacing between injection sets in the second injection head.

* * * * *